United States Patent [19]

Staerzl

[11] Patent Number: 4,739,742

[45] Date of Patent: Apr. 26, 1988

[54] THROTTLE-POSITION SENSOR FOR AN ELECTRONIC FUEL-INJECTION SYSTEM

[75] Inventor: Richard E. Staerzl, Fond du Lac, Wis.

[73] Assignee: Brunswick Corporation, Skokie, Ill.

[21] Appl. No.: 78,819

[22] Filed: Jul. 28, 1987

[51] Int. Cl.[4] ..... F02D 41/34

[52] U.S. Cl. ..... 123/494; 123/478; 123/488

[58] Field of Search ..... 123/399, 478, 494, 488

[56] References Cited

U.S. PATENT DOCUMENTS

| | | | |
|---|---|---|---|
| 3,884,195 | 5/1975 | Murtin et al. . | |
| 4,131,088 | 12/1978 | Reddy . | |
| 4,280,465 | 7/1981 | Staerzl | 123/494 |
| 4,349,000 | 9/1982 | Staerzl | 123/491 |
| 4,549,517 | 10/1985 | Kamiyama . | |

*Primary Examiner*—Tony M. Argenbright
*Attorney, Agent, or Firm*—Hopgood, Calimafde, Kalil, Blaustein & Judlowe

[57] ABSTRACT

Interpreted intake-manifold vacuum and engine speed are used to produce an electrical output signal that reflects throttle position. Since the device has no mechanical tie to the throttle, there is none of the hysteresis or mechanical wear that are characteristic of conventional throttle-position sensors. The device comprises a tachometer circuit which is modulated by the signal from a differential-pressure transducer, connected to track the instantaneous pressure drop across the engine throttle. The tachometer output controls the duty cycle of a pulse generator which, in turn, drives an output transistor; a reference potential is applied across the load resistor and emitter of this output transistor, and the output signal is obtained as a d-c control signal, upon filtering the signal from the collector of the output transducer. The transfer function of the device yields maximum output when there is little or no intake vacuum, e.g., at sustained high speed, and minimum output is obtained from minimum speed and maximum vacuum.

3 Claims, 2 Drawing Sheets

THROTTLE-POSITION SENSOR FOR AN ELECTRONIC FUEL-INJECTION SYSTEM

BACKGROUND OF THE INVENTION

The invention relates to electronic fuel-injection circuitry for internal-combustion engines and is more particularly concerned with generation of suitable throttle-responsive fuel-flow control signals used in such circuitry.

Reference is made to my U.S. Pat. Nos. 3,305,351 and 4,349,000 for detailed discussion of pulse-width modulating circuitry for operation of the solenoids of fuel-injectors in a variety of engines of the character indicated. The disclosure in said patents, for example in connection with FIG. 6 of said U.S. Pat. No. 4,349,000, is concerned with circuit accommodation of various input parameters, in the form of analog voltages which reflect air-mass flow for the current engine speed, and a correction is made for volumetric efficiency of the particular engine, to arrive at a pulse-width modulating voltage $E_{MOD}$. in a line to each of two like square-wave pulse generators. These pulse generators respectively serve for fuel-injection control in different groups of cylinders in the involved engine. The input parameters include engine speed and throttle setting, and the disclosure is for a potentiometer to track throttle setting, which is the customary provision for general public acceptability—i.e., for normal commercially satisfactory performance.

However, for racing performance, as when a marine outboard engine is expected to sustain operating speeds in excess of 6,000 rpm, there is such a short life for the best available throttle-tracking potentiometer as to jeopardize performance in a given race, and the potentiometer must be replaced altogether too often.

BRIEF STATEMENT OF THE INVENTION

It is an object of the invention to provide improved means for effectively translating throttle position into a suitably related fuel-flow control signal, for engines of the character indicated.

It is a specific object to meet the above object without use of a potentiometer or any other mechanical means to track throttle position.

Another specific object is to meet the above objects with means affording inherently greater life, and superior performance and reliability, in racing use of such engines.

The invention meets the above objects and provides certain further advantageous features in a device which interprets intake-manifold vacuum and engine speed to produce an output signal that reflects throttle position. Since the device has no mechanical tie to the throttle, there is none of the hysteresis or mechanical wear that are characteristic of conventional throttle-position sensors.

The device comprises a tachometer circuit which is modulated by the signal from a differential-pressure transducer, connected to track the instantaneous pressure drop across the engine throttle. The tachometer output controls the duty cycle of a pulse generator which, in turn, drives an output transistor; a reference potential is applied across the load resistor and emitter of this output transistor, and the output signal is obtained as a d-c control signal, upon filtering the signal from the collector of the input transducer.

The transfer function of the device yields maximum output when there is little or no intake vacuum, e.g., at sustained high speed, and minimum output is obtained from minimum speed and maximum vacuum.

DETAILED DESCRIPTION

Figure 1:
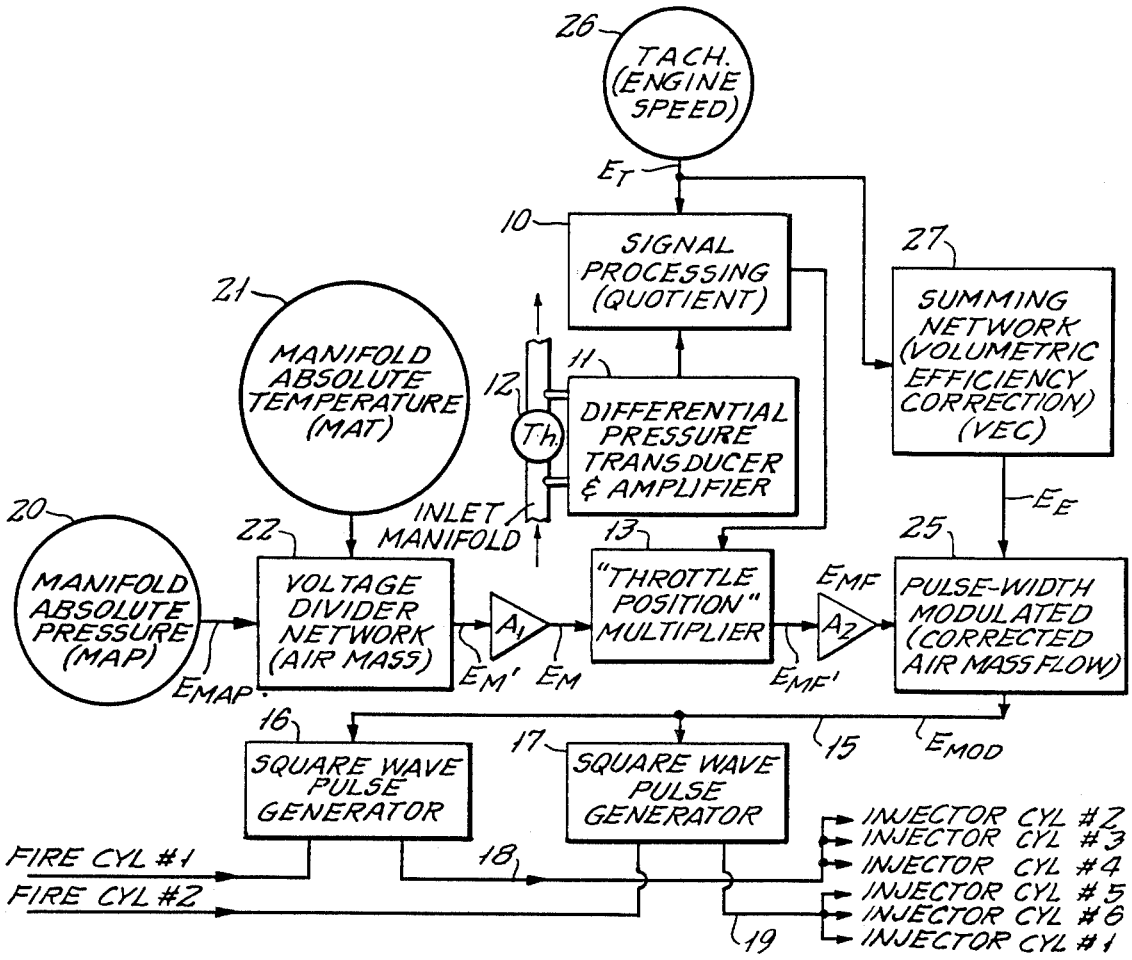
Figure 2:
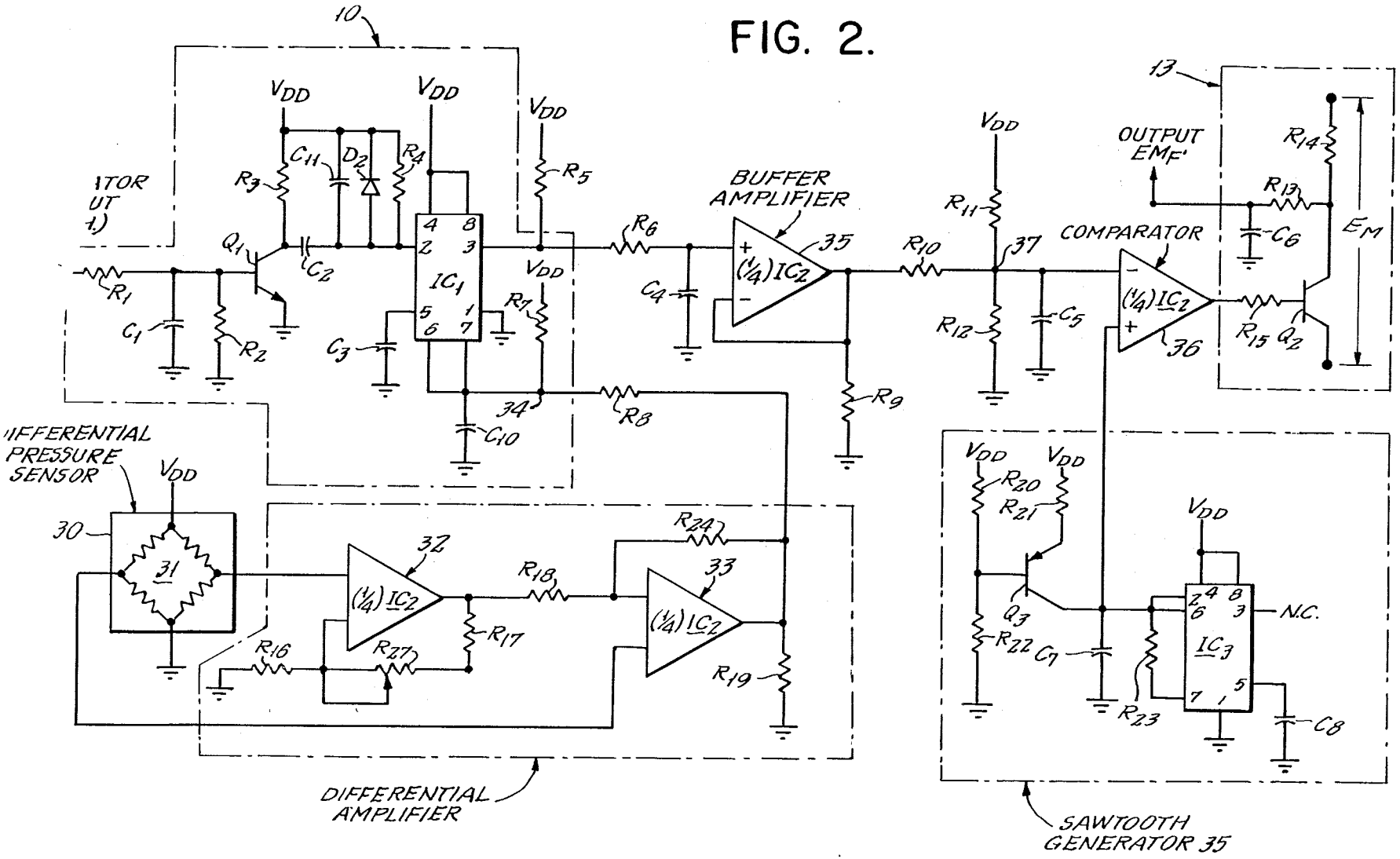

A preferred embodiment of the invention will be described in detail in conjuntion with the accompanying drawings, in which:

FIG. 1 is an electrical block diagram, schematically indicating components of circuitry of the invention, in the context of other components of fuel-injection control circuitry, applicable to a variety of different fuel-injection engines; and FIG. 2 is a more explicit circuit diagram to show detail of the presently preferred component combination of the invention.

The diagram of FIG. 1 is similar to FIG. 6 of said U.S. Pat. No. 4,349,000, in order to show context for FIG. 2 circuitry of the invention, the same being shown in FIG. 1 as signal-processing circuitry 10, operative upon tachometer voltage $E_T$ and being modulated by the output signal of a differential-pressure transducer 11 connected for response to the instantaneous drop in pressure across the engine throttle 12. This pressure drop will be understood to be a function of the negative-pressure or vacuum condition at the intake manifold of the engine; specifically, at full throttle and maximum speed, the pressure drop to zero or near zero, and the pressure drop is greatest at minimum throttle (and therefore at minimum engine speed). The modulated-signal output of the signal-processing circuitry 10 is supplied as a d-c analog voltage for multiplication at 13 with a voltage $E_M$, and the product of this multiplication is a fuel-control voltage $E_{MF}$; in other words, the elements 10, 11, 12 and 13 of FIG. 1 replace the potentiometer 53 and throttle control 54 of FIG. 6 of said patent. The expression "THROTTLE-POSITION" at multiplier 13 in FIG. 1 will be understood to express the effective accomplishment of mechanically tracking throttle position, without having resort to any mechanical motion-tracking to achieve this result.

As suggested by legends in FIG. 1, the circuit of FIG. 1 is shown in application to the development of fuel-injection voltage pulses for operation of a two-cycle V-6 engine described in detail in said U.S. Pat. No. 4,349,000, and said circuit operates on various input parameters, in the form of analog voltages which reflect air-mass flow for the current engine speed, a correction being made for volumetric efficiency of the particular engine, to arrive at a modulating-voltage output $E_{MOD}$. in a line 15 to each of two like square-wave pulse generators 16–17. Depending upon the magnitude of the modulating voltage $E_{MOD}$. in line 15, the square-wave output at 18 will be of predetermined duration, and the square-wave output at 19 will be of duration identical to that in line 18, it being understood that the predetermined duration is always a function of instantaneous engine-operating conditions.

More specifically, for the circuit shown, a first electrical sensor 20 of manifold absolute pressure is a source of first voltage $E_{MAP}$ which is linearly related to such pressure, and a second electrical sensor 21 of manifold absolute temperature may be a thermistor which provides a voltage linearly related to such temperature, through a resistor network 22. The voltage $E_{MAP}$ is divided by the network 22 to produce an output voltage $E_{M'}$ which is a linear function of instantaneous air-mass or density at inlet of air to the engine. A first amplifier $A_1$ provides the output voltage $E_M$ which is one of the inputs to multiplier 13. The voltage product $E_{MF}$ of multiplier 13 reflects instantaneous air-mass flow for the instantaneous effective throttle (12) setting and engine speed, and a second amplifier $A_2$ provides a corresponding output voltage $E_{MF}$ for application to one of the voltage-multiplier inputs of a modulator 25, which is the source of $E_{MOD}$. The other voltage-multiplier input of modulator 25 receives an input voltage $E_E$ which is a function of engine speed (tachometer 26) and volumetric efficiency (network 27).

Referring now to FIG. 2 wherein "VDD" will be understood to mean connection to the engine's regulated power supply (not shown in detail), about 8 volts; and legend indicates use of the engine alternator (not shown) to provide a tachometer function by reason of its frequency dependence upon engine rpm. This alternator voltage enters the signal-processing circuitry at a filter $R_1$-$C_1$, so that the alternator output frequency in the voltage across an amplifier-input resistor $R_2$ can be clean, i.e., free of high-frequency (rf) noise. High-gain amplification via a transistor $Q_1$ converts the sinusoidal output of the alternator to a square-wave voltage (at alternator frequency) across a resistor $R_3$. A capacitor $C_2$ differentiates the square-wave voltage, producing a series of sharply defined positive pulses; after diode clipping at $D_2$, only the negative voltage pulses remain across a resistor $R_4$, for recycle-triggering of an integrated circuit $IC_1$, which may be of the type-555 variety, connected for operation as a monostable multivibrator. Circuit constants are suitably selected so that such triggering results from cut-off of each rising multivibrator voltage at about the $\frac{2}{3}$ VDD point.

A differential-pressure transducer 30 may include a strain-gage bridge 31, for developing an electrical response to the instantaneous pressure drop across the throttle 12 of FIG. 1. As shown, this electrical response is processed by operational amplifiers 32–33 and associated resistors $R_{16}$, $R_{17}$ (as trimmed at $R_{27}$) and $R_{18}$, to deliver a multivibrator-modulating voltage in the range from zero or near-zero, to six volts; this modulating voltage appears at the connection 34 between resistors $R_7$–$R_8$ and is determinative of the level at which each recycled multivibrator-voltage rise commences. The multivibrator output appears across a resistor $R_5$ as a succession of square-wave voltage pulses at tachometer frequency and with a duty cycle which is an inverse function of the voltage derived from the pressure drop across throttle 12. Filter action via elements $R_6$-$C_4$ smooths this pulsing voltage to a d-c voltage at the positive (+) input of an operational amplifier 35, connected as a buffer, for isolation of its d-c voltage output across a resistor $R_9$.

It can be observed that the described utilization of $IC_1$ and its associated circuitry is to produce an electrical-signal output which is the quotient of instantaneous engine speed divided by instantaneous pressure drop across the throttle. And both the numerator and denominator voltage values relied upon for the quotient are individually proportioned to the same power-supply voltage VDD, thus inherently cancelling any quotient dependence upon fluctuations in power-supply voltage.

The smoothed and buffered quotient voltage which appears across resistor $R_9$ contains all the effective "throttle-positioning" data needed for replacement of the mechanically tracking throttle potentiometer 11 of FIG. 1 of said U.S. Pat. No. 4,349,000, the only remaining problem being that of effectively multiplying the voltage $E_M$ by this quotient voltage to achieve the voltage $E_{MF}$ needed by the control unit 25.

In the form shown, the effective multiplication is achieved by connecting the voltage $E_M$ across a switching transistor $Q_2$ and its load resistor $R_{14}$, and by using the quotient voltage value to control the duty cycle of switch $Q_2$; the resulting time-modulated output is smoothed by filter means $R_{13}$-$C_6$ to yield the d-c output voltage $E_{MF}$ needed by the control unit.

More specifically, a second integrated circuit $IC_2$, which may also be the same type 555 as $IC_1$, is connected with associated circuitry as a sawtooth generator 35, operating at a frequency of about 1000 Hz and supplying its sawtooth-voltage output to the positive (+) input of an operational amplifier 36. The latter is connected as a comparator, with quotient voltage applied to the negative (−) input. The sawtooth voltage thus recurrently scans the current level of quotient voltage to determine the on/off duty cycle of the switching transistor $Q_2$.

Further specifically, for stabilized presentation of current quotient values within a desired 2 to 5-volt range and level at the negative (−) input of comparator 36, the quotient voltage at $R_9$ is applied via a coupling resistor $R_{10}$ to the connection point 37 of resistors $R_{11}$–$R_{12}$ which divide the power-supply voltage VDD.

The described circuit will be seen to achieve all stated objectives. In particular, throttle position is effectively sensed at all times, without resort to any mechanical tracking of throttle position. The result is hysteresis-free operation which is insensitive to vibration and which portends greatly extended life, under the most demanding conditions of racing performance.

Specific component values for elements indicated in FIG. 2 may be listed as follows:

| | |
|---|---|
| **A. Resistors:** | |
| $R_1$ = 10K ohms | $R_{14}$ = 2K ohms |
| $R_2$ = 10K ohms | $R_{15}$ = 100K ohms |
| $R_3$ = 6.8K ohms | $R_{16}$ = 100K ohms |
| $R_4$ = 20K ohms | $R_{17}$ = 619 ohms |
| $R_5$ = 6.8K ohms | $R_{18}$ = 866 ohms |
| $R_6$ = 100K ohms | |
| $R_7$ = 332K ohms | $R_{19}$ = 1K ohms |
| $R_8$ = 634K ohms | $R_{20}$ = 33K ohms |
| $R_9$ = 1K ohms | $R_{21}$ = 300K ohms |
| $R_{10}$ = 71.5K ohms | $R_{22}$ = 100K ohms |
| $R_{11}$ = 100K ohms | $R_{23}$ = 10K ohms |
| $R_{12}$ = 150K ohms | $R_{24}$ = 100K ohms |
| $R_{13}$ = 10K ohms | $R_{27}$ = 500 ohms |
| **B. Capacitors:** | |
| $C_1$ = 1 μf | $C_5$ = 1 μf |
| $C_2$ = 0.02 μf | $C_6$ = 10 μf |
| $C_3$ = 0.01 μf | $C_7$ = 0.01 μf |
| $C_4$ = 1 μf | $C_8$ = 0.01 μf |
| | $C_{11}$ = 0.005 μf |

C. The four operational amplifiers (32, 33, 35, 56) are suggested by legend to be individual quarter segments of a single integrated circuit component $IC_2$, variously connected as above described.

Although the invention has been shown and described in detail for a preferred form, it will be understood that modifications may be made without departing from the scope of the invention.

What is claimed is:

1. In an electronic fuel-injection control circuit for an internal-combustion engine, wherein throttle setting and tachometer output are necessary ingredients in the generation of an electrical control signal for pulse-width modulation of a square-wave generator of fuel-injector excitation pulses, the improvement wherein (1) a first signal reflecting throttle setting is developed by a differential-pressure transducer which is connected to track the instantaneous pressure drop across the throttle and is therefore related to the instantaneous manifold vacuum-flow condition of the engine, and (2) a second signal reflecting tachometer output is modulated by said first signal to develop the electrical control signal for such pulse-width modulation.

2. The improvement of claim 1, in which the engine includes a local voltage supply, and in which each of said first and second signals is an independent function of the voltage output of said supply.

3. The improvement of claim 1, in which the tachometer is an alternator whereby said second signal is characterized by frequency indicative of engine speed, in which a square-wave generator is connected for operation by said second signal to produce a square-wave output at alternator frequency, and in which the modulation by said first signal is a duty-cycle modulation of said square-wave generator, the sense of such modulation being inverse as between the direction of first-signal change and the direction of resulting duty-cycle change.

* * * * *